United States Patent [19]

Montacie

[11] 4,170,383

[45] Oct. 9, 1979

[54] TUNNELING MACHINES AND OTHER CUTTING MACHINES

[75] Inventor: Marcel Montacie, Paris, France

[73] Assignee: Bouygues, Clamart, France

[21] Appl. No.: 870,215

[22] Filed: Jan. 17, 1978

[30] Foreign Application Priority Data

Jan. 21, 1977 [FR] France ..... 77 01719

[51] Int. Cl.[2] ..... E21D 9/00

[52] U.S. Cl. ..... 299/56; 37/190

[58] Field of Search ..... 299/56–59, 299/85, 86, 31, 33; 37/190, 189

[56] References Cited

U.S. PATENT DOCUMENTS

| | | | |
|---|---|---|---|
| 902,517 | 10/1908 | Wittich | 299/56 |
| 1,326,480 | 12/1919 | Dana | 299/56 |
| 1,403,530 | 1/1922 | Whitaker et al. | 299/56 |
| 4,043,600 | 8/1977 | Dyer | 299/33 |

*Primary Examiner*—William Pate, III

*Attorney, Agent, or Firm*—Dressler, Goldsmith, Clement, Gordon & Shore, Ltd.

[57] ABSTRACT

The invention relates to a tunneling machine or other machine provided with tools for cutting materials from a wall located in front of the machine, said machine comprising a movable frame carrying a head rotatably driven about an axis, said head bearing at least one bucket for picking up said materials after cutting and for dumping the materials on or towards a conveyor, said bucket having an inlet opening for picking up the materials when the bucket passes through a low position during the rotation of the head, and said bucket having an outlet opening for dumping the materials, said outlet opening being offset to the rear of the head with respect to the said inlet opening.

8 Claims, 6 Drawing Figures

FIG_1
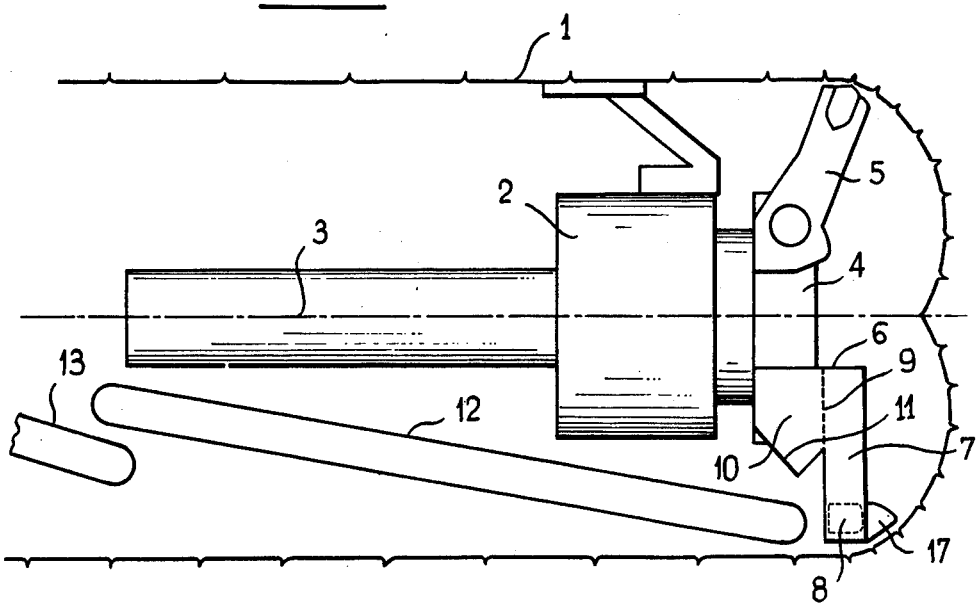
FIG_2
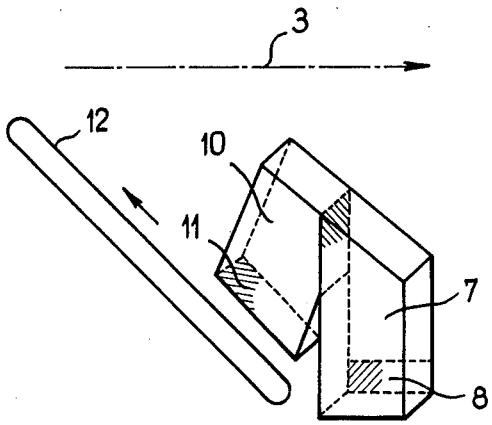
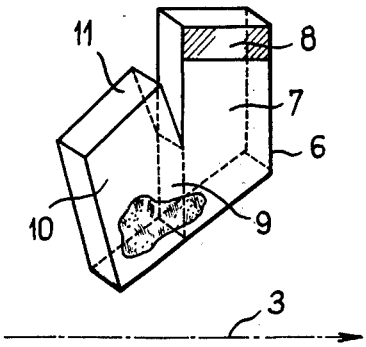
FIG_3

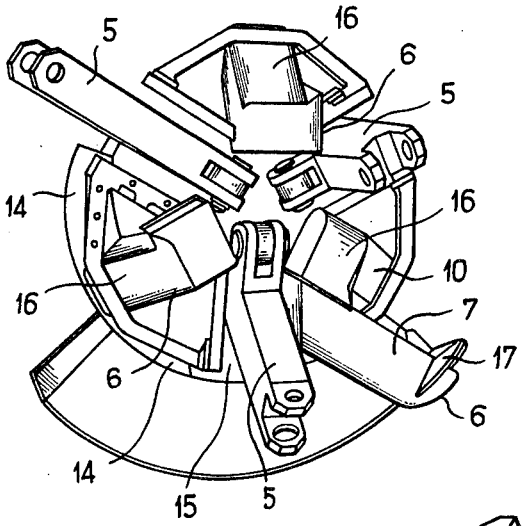
FIG. 4
FIG. 5
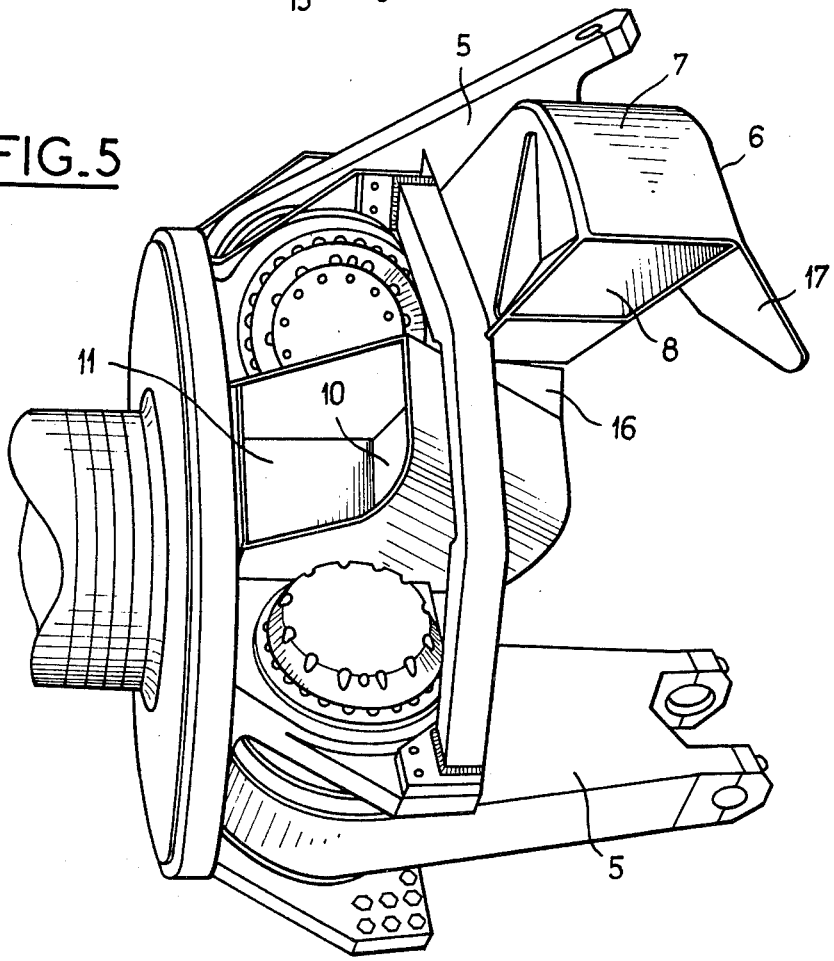

TUNNELING MACHINES AND OTHER CUTTING MACHINES

BACKGROUND OF THE INVENTION

The invention relates to tunneling machines and other boring and cutting machines provided with tools for detaching materials from a wall located in front of the machine.

Such machines are used for boring a tunnel or similar, totally or partially underground, or for mining or digging.

Some machines are provided with a device for removing materials cutted from the wall, as disclosed in the French Patent No. 1 597 434 for instance.

This Patent discloses a tunneling machines which comprises a movable frame carrying a head rotatably driven about a longitudinal and approximately horizontal axis and provided with cutting tools, this head also carrying buckets located between the tools, each bucket picking up the materials when it passes in a lower position and further dumping the materials to a conveyor when the bucket passes in an upper position.

Such a tunneling machine is too bulky to be usable when the diameter of the gallery is small, say 2 to 3 meters.

SUMMARY OF THE INVENTION

The present invention aims at providing a tunneling machine or other cutting machines well designed to be used in a tunnel having a small diameter.

According to the invention, the bucket is provided with a material outlet opening which is offset to the rear of the head with respect to the material inlet opening of the bucket.

The rotation of the head provokes inside the bucket a shifting of the materials towards the rear of the head.

The upward run of the bucket is preferably used to provoke this shifting.

Thus a fundamental difference between the invention and the prior art is that the passage of the bucket about its highest position corresponds to a shifting of the excavated material towards the rear, inside the bucket, in the case of the present invention, whilst it corresponds to a dumping of the excavated material from the bucket to a conveyor in the case of the prior art.

According to another feature of the present invention, the downward run of the bucket is employed to provoke the dumping of the shifted material out of the bucket.

The last quarter of rotation of the bucket is preferably used to provoke this dumping.

In a preferred embodiment, dumping is effected when the bucket is approaching its collecting position, this constituting another typical difference from the prior art according to which dumping is effected when the bucket is opposite its collecting position.

A bucket according to a preferred embodiment of the present invention comprises an outlet opening located to the rear and near the inlet opening of the bucket so as to be in position of dumping by gravity, preferably beneath the axis of rotation of the bucket, when the inlet of the bucket arrives about its collecting position.

The bucket may be of any shape, but preference is given to shapes which allow a regular displacement of the collected product from the inlet opening to the outlet opening of the bucket.

In a simple embodiment, the bucket comprises an inlet passage inside which the excavated material moves during the upward run of the bucket, an outlet passage inside which the excavated material moves during the downward run of the bucket, the transfer from one passage to the other being effected directly or via an intermediate passage during the change in run of the bucket about its highest position.

BRIEF DESCRIPTION OF THE SEVERAL VIEWS OF THE DRAWINGS

The invention will be more readily understood on reading the following description with reference to the accompanying drawings, in which:

FIG. 1 is a schematic elevation of a machine according to the invention in a galery;

FIG. 2 is a diagram of a bucket according to the invention in low, collecting position;

FIG. 3 is a diagram of the bucket of FIG. 2 in its highest position when the excavated material is shifted;

FIG. 4 is a front view of the rotary head of a machine according to the invention, some of the pieces having been removed to show the typical parts of the invention more clearly;

FIG. 5 is a side view of the rotary head of the machine of FIG. 4 which shows a bucket according to the invention on a larger scale.

DETAILED DESCRIPTION

Figure 6:
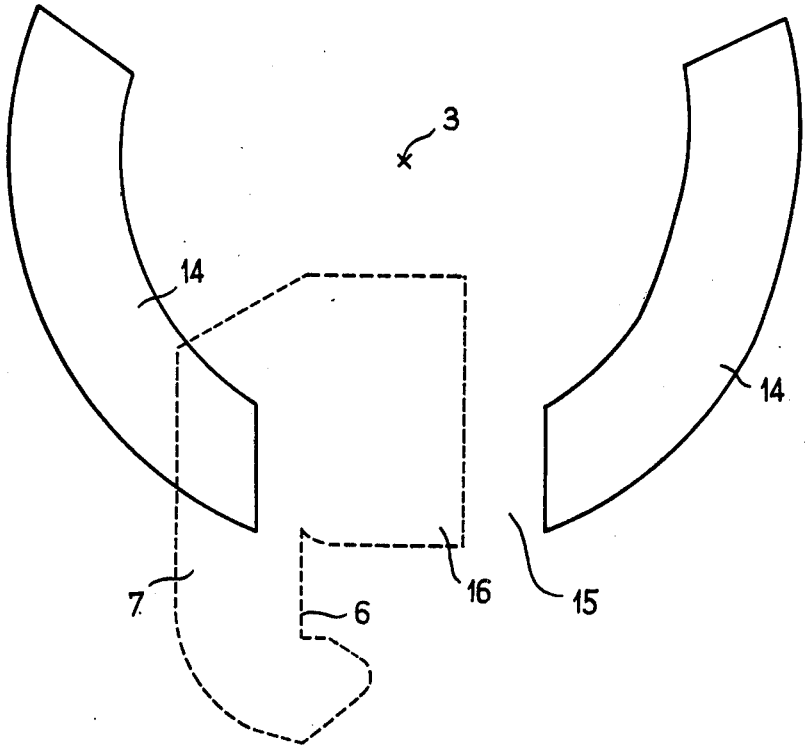
FIG. 6 is a schematic front view of a truncated deflector against which the outlet of the bucket moves during the rotation of the bucket, the bucket itself being shown in broken lines in this Figure.

Referring now to the drawings, FIG. 1 schematically shows the machine according to the invention in longitudinal view in a galery 1 being excavated, which machine comprises a frame 2 on which a head 4 is mounted to rotate about axis 3, on which head are mounted tool-holder arms 5 and buckets 6.

Particular attention will be given to the structure of the buckets 6, as the rest of the machine per se does not form part of the present invention.

The rotating head 4 generally bears a plurality of tool-holding arms 5 and a plurality of buckets disposed between said tool holders and moved along a circumferential path having a low point and a high point.

In the embodiment shown (FIG. 4), it has been assumed, solely by way of example, that the machine comprises three tool-holder arms and three buckets.

According to the present invention, each bucket 6 comprises an inlet passage 7 provided at one end with an opening 8 and communicating via an outlet passage 9, at its other end, with an outlet passage 10 provided with an outlet opening 11. As illustrated in FIG. 2, passages 7 and 9 extend generally parallel to each other.

The opening 11 is disposed to the rear of and near the opening 8, but the two openings are facing different directions.

The opening 8 is substantially parallel to the axis of rotation 3 about which the bucket rotates and is directed along the path for bucket 6, whilst the opening 11 is disposed to describe substantially a truncated surface about the axis of rotation 3.

It has been assumed in the Figures that the head 4 which carries the bucket rotates in anti-clockwise direction.

FIG. 1 shows a bucket 6 in its collecting position which corresponds substantially to the passage of the bucket in its lowest position along the path. In this position, the excavated material accumulated at the bottom of the face of the galery is taken through the opening 8 and penetrates in the passage 7.

During the upward run of the bucket from the position illustrated in FIG. 1 to that illustrated in FIG. 2, these products move towards the other end of passage 7 and are transferred through communicating passage 9 to one end of the outlet passage 10. This transfer is normally terminated when the bucket passes through its highest position, at the end of its upward run.

The transfer from passage 7 to passage 10 may be effected directly through a common opening 9 or through an intermediate passage.

In the highest position of the bucket, the excavated material accumulated in the bottom of passage 10 cannot leave the passage since the opening 11 is at this moment directed upwardly, which position is generally illustrated in FIG. 2.

The subsequent downward run of the bucket has for its effect to progressively incline the opening 11 downwardly until maximum inclination which corresponds substantially to the lowest point of the run of the bucket below the axis of rotation 3, thus also to the beginning of collecting position which corresponds to FIG. 2.

In this position, the excavated material which has been progressively displaced towards the outlet end 11 of passage 10 drops freely through opening 11 and is collected by a conveyor 12 (FIG. 3) which extends along the length of the machine and which shifts the excavated material rearwardly, possibly towards another conveyor 13 (FIG. 1).

To avoid the excavated material falling from the conveyor, a deflector 14 is provided which may have the form of part of a conical frustum centred on the axis of rotation 3. It is not necessary for this conical frustum to rise higher than the horizontal passing through the axis 3 and it is interrupted at the spot where the conveyor is located. FIG. 6 shows a front view of this conical frustum 14 with its gap 15. The outlet 11 of the bucket is designed substantially to sweep the inner face of the conical frustum during the rotation of the bucket.

This form of the deflector and the outlet opening of the bucket may vary, in the same way as different forms may be chosen for passing from the inlet opening to the outlet opening of the bucket.

FIGS. 4 and 5 show by way of example an embodiment in which the bucket 6 is composed of a rectilinear inlet passage 7 of generally square or rectangular section, a likewise rectilinear outlet passage 10 of substantially rectangular section, these two passages communicating via an intermediate passage 16.

FIG. 5 shows the opening 8 of the passage 7 and the outlet opening 11 of passage 10, as well as a part of the intermediate passage 16.

In manner known per se, the inlet opening 8 is provided with an attachment 17 which facilitates the collecting of the excavated material. The outlet opening 11 is a flat outlet which is oblique or inclined with respect to the axis of the outlet passage and with respect to the axis of rotation of the buckets. FIG. 5 also shows two of the tool-holder arms between which the bucket 6 is located.

In this construction, the buckets are formed by assembling the three passages of which they are composed. In FIG. 4, only one of the buckets is complete and comprises these three passages 7, 16 and 10.

In FIGS. 4 and 5, the tool-holders 5 have been shown without their tools.

What is claimed is:

1. A cutting machine for cutting materials from a wall located in front of the machine including a movable frame having a cutting head rotatable about a fixed horizontal axis, said cutting head supporting at least one bucket adjacent the periphery thereof and rotatable about a circumferential path having a low point and a high point for picking up the material and depositing the material on a conveyor, said bucket having an inlet opening and an outlet opening axially spaced from each other with said outlet opening spaced rearwardly of said inlet opening in the direction of travel of said frame, said inlet and outlet openings having separate inlet and outlet passages leading therefrom and communication means between said passages spaced radially inwardly with respect to said axis from said inlet and outlet openings.

2. A cutting machine as defined in claim 1, wherein said inlet and outlet openings are positioned such that said material is received into said inlet opening adjacent said low point and moved along said inlet passage while said bucket is moved from said low point toward said high point and said material is passed through said communication means while said bucket is above said axis and said material flows through said outlet opening below said axis for deposit onto said conveyor.

3. A cutting machine as defined in claim 2, wherein said inlet and outlet passages extend generally parallel to each other and said communication means is defined by an opening between said passages adjacent the ends of said passages opposite said inlet and outlet openings.

4. A cutting machine as defined in claim 2, in which said inlet and outlet openings extend substantially perpendicular to each other.

5. A cutting machine as defined in claim 4, in which said inlet opening is directed generally along said path and said outlet opening is directed away from said axis.

6. A cutting machine as defined in claim 1, wherein said passages and openings are arranged such that said material flows from said outlet opening below said axis.

7. A cutting machine as defined in claim 6, in which said inlet opening is located substantially parallel to said axis and said outlet opening is inclined with respect to said outlet passage and said axis.

8. A cutting machine as defined in claim 2, in which the frame has an arcuate deflector aligned with said outlet opening for blocking said opening during at least a part of said path of travel, said deflector having an opening below said axis through which said material flows from said outlet opening.

* * * * *